United States Patent [19]

Benetti

[11] Patent Number: 4,942,680

[45] Date of Patent: Jul. 24, 1990

[54] SKI BOOT

[75] Inventor: Cristiano Benetti, Postioma/TV, Italy

[73] Assignee: Lange International S.A., Switzerland

[21] Appl. No.: 399,856

[22] Filed: Aug. 29, 1989

[30] Foreign Application Priority Data

Nov. 24, 1988 [CH] Switzerland ..... 4364/88

[51] Int. Cl.[5] ..... A43B 5/04

[52] U.S. Cl. ..... 36/119; 36/117

[58] Field of Search ..... 36/117, 118, 119, 120, 36/121

[56] References Cited

U.S. PATENT DOCUMENTS

| | | | |
|---|---|---|---|
| 4,539,763 | 9/1985 | Walkoff | 36/119 X |
| 4,593,483 | 6/1986 | Paris | 36/119 |
| 4,644,671 | 2/1987 | Walkoff | 36/119 |
| 4,698,922 | 10/1987 | Sartor | 36/119 |
| 4,706,393 | 11/1987 | Maryer | 36/117 |
| 4,760,653 | 8/1988 | Baggio | 36/117 |
| 4,785,555 | 11/1988 | Sartor | 36/119 |
| 4,811,503 | 3/1989 | Iwama | 36/119 |
| 4,823,485 | 4/1989 | Kemmer | 36/119 |

FOREIGN PATENT DOCUMENTS

| | | | |
|---|---|---|---|
| 0284978 | 10/1988 | European Pat. Off. | 36/117 |
| 0316540 | 5/1989 | European Pat. Off. | 36/117 |
| 3715095 | 11/1987 | Fed. Rep. of Germany | 36/117 |
| 3834057 | 4/1989 | Fed. Rep. of Germany | 36/117 |
| 0225534 | 6/1987 | France | 36/117 |
| 0668165 | 12/1988 | Switzerland | 36/117 |

*Primary Examiner*—Paul T. Sewell
*Assistant Examiner*—Andrew D. Meyers
*Attorney, Agent, or Firm*—Kane, Dalsimer, Sullivan, Kurucz, Levy, Eisele and Richard

[57] ABSTRACT

Boot formed of a shell base (1) and a shank (2, 3) articulated on this shell base. The foot is gripped diagonally by means of a cord (5) passing over a pressure distributor (6), on which cord there acts a stretcher (7) mounted on the rear part (3) of the shank. The cable (5) forms a loop on the pressure distributor (6), sliding in a return device (11). One of the strands (5*a*) of the loop passes under the articulation (4), while the other strand (5*b*) passes above this articulation, in a manner such that there is neither any increase in the compression of the instep, nor any relaxation, during forward flexion.

4 Claims, 1 Drawing Sheet

FIG 1
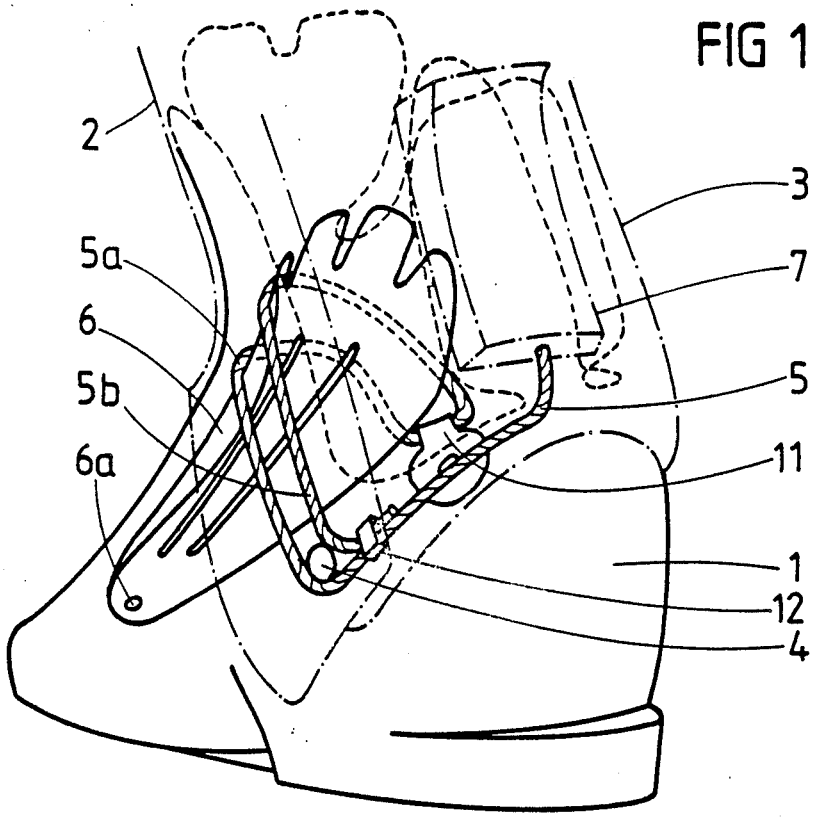
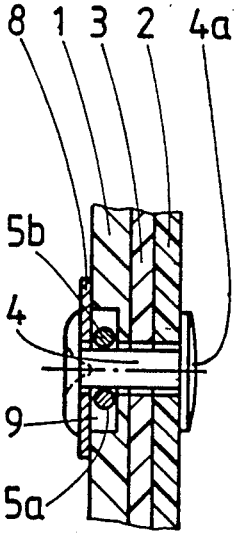
FIG 3
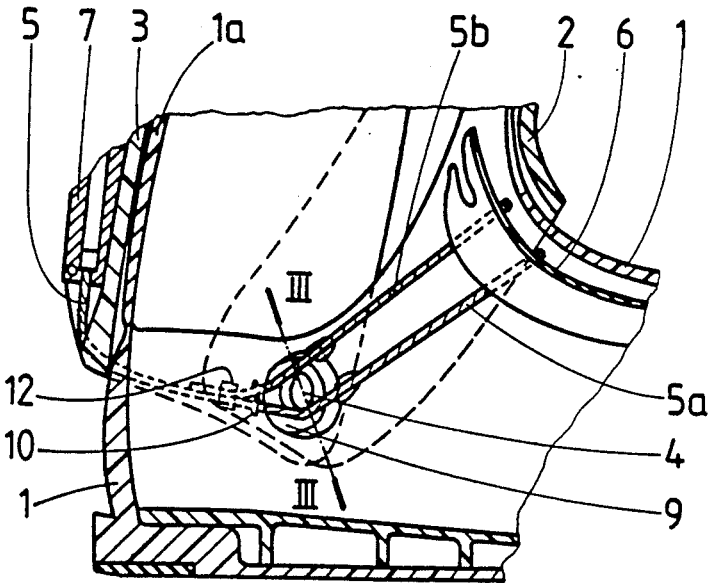
FIG 2

SKI BOOT

FIELD OF THE INVENTION

The present invention relates to a ski boot formed by a lower part in the form of a shell, comprising the sole and surrounding at least the foot and the heel, and a shank formed by a front part and a rear part whereof at least the rear part is articulated on the lower shell-shaped part about a transverse pivot, and comprising diagonal gripping means formed by a pressure distributor situated within the boot, at the level of the instep, and a stretcher device mounted at the back of the boot, on said articulated rear part of the shank, in order to exert a traction on the pressure distributor towards the heel by means of at least one cord or the like passing over said distributor guided by guide means disposed laterally on the boot in order to orient the action of the cord on the distributor towards the heel.

PRIOR ART

This type of ski boot, called the rear-entry type, has become widespread in the past few years. To obtain clamping of the foot towards the heel, that is to say diagonal clamping, the clamping cord has to change direction in the region of the articulation of the shank to the shell. Some manufacturers have elected to pass the cord below the articulation pivot. In this case, the flexion of the shank of the boot causes a traction on the cord and consequently increases the clamping of the foot. This effect was even intentional in the boot described in patent No. FR 2 345 097. It is systematically encountered in numerous subsequent patents, such as patent Nos. FR 2 589 690, 2 577 118, 2 536 965, 2 553 634, 2 514 621 and 2 564 327. It has however been realized that the increase in the pressure on the instep during forward flexion of the leg is not favourable for the foot. In fact, for the practice of skiing, it is appropriate for the foot to be well retained, which requires a substantial initial clamping. On the other hand, during flexion of the leg, the anterior tendon of the leg moves away from the heel, which produces the effect of dilation of the foot at the level of the instep. It will be understood, under these conditions, that an increase in the compression of the instep may become uncomfortable or even painful. On the basis of this finding, it has already been proposed to pass the cord above the pivot of articulation of the shank in a manner such as to eliminate this increase in compression. Such a boot has been described in document No. EP-A-157 240. It is clear that in this case a relaxation effect takes place when the leg is flexed forwards. Such a relaxation may be detrimental to good guiding of the skis.

In order to obtain a neutral behaviour, that is to say with no increase in compression and no relaxation during flexion of the leg, it was thus appropriate to pass the cord precisely over the pivot of articulation of the shank of the boot. It is this which is proposed in document No. EP-A-0 144 209 which describes a boot in which the pivot of the articulation of the shank is pierced by a transverse hole for the passage of the cord. In order for the cord to be able to slide satisfactorily in this hole, it is necessary for the latter to possess an adequate curvature. Such a design is relatively complex.

The object of the present invention is to obtain a boot having a neutral behaviour, as defined above, without it being necessary to pass the cord into a hole intercepting the articulation pivot.

SUMMARY OF THE INVENTION

The boot according to the invention is a boot wherein the cord or the like forms a loop passing, on one side of the boot below and above the pivot of articulation of the rear part of the shank, substantially at the same distance from this pivot, and, on the other side of the boot freely through a return device fixed to the inside of the shell, in a manner such that during flexion of the shank of the boot the traction exerted by the cord on the distributor is virtually unchanged.

During flexion of the leg, that is to say during forward pivoting of the shank, the part of the cord passing below the pivot of articulation of the shank is subjected to a traction, but this traction is compensated by a relaxation of the part of the cord passing above the pivot of articulation in a manner such that the traction on the pressure distributor is virtually unchanged.

The loop can be closed at the level of the stretcher, that is to say that in this case the two ends of the loop are connected to the stretcher device. The loop can likewise be closed at a point situated between the stretcher device and the articulation of the shank.

The division of the cord into two strands on the pressure distributor further has a favourable effect in distributing the load on the pressure distributor and consequently on the instep.

BRIEF DESCRIPTION OF THE DRAWINGS

The attached drawing shows, by way of example, an embodiment of the invention.

FIG. 1 is a three-quarter view from the rear part of a boot.

FIG. 2 is a partial view in vertical longitudinal section through the same boot.

FIG. 3 is a detailed view in section along III—III in FIG. 2.

Boot shown is a boot of the rear-entry type.

DESCRIPTION OF THE PREFERRED EMBODIMENTS

In FIG. 1 the boot is represented as transparent, in a manner such as to show the interior. The boot comprises a shell or shell base 1 shown in solid lines, which comprises the sole and surrounds the foot and the heel. This shell base likewise has a part extending over the instep and a tongue extending over the Achilles tendon. On this shell base 1 is articulated a shank in two parts formed by a front cover 2 and a rear cover 3 which fits into the front cover 2. The covers 2 and 3 are articulated on the shell base 1, on each side of the latter, by means of two pivots, only the left-hand pivot 4, which concerns us here, being shown. Within the boot, the foot is retained by means of a cord 5 passing over a pressure distributor 6 formed by a tongue of semi-rigid plastic and having a shape of a saddle extending over the instep between the shell and a comfort liner (not shown). This type of boot and tongue is well known per se. The tongue may be fixed to the liner by its lower end 6*a* or, in another embodiment, by its upper part to the shell. One of the ends of the cord 5 is connected to a stretcher 7 mounted on the rear cover 3 of the shank. Such stretchers are described, for example, in document Nos. EP-A-0 157 240, EP-A-0 114 209 and EP-A-0 230 063. The stretcher 7 could likewise be of the drum type as described in U.S. Pat. No. 4,620,378.

The shank is articulated by means of rivets. The articulation point shown is produced by means of a rivet 4 whose head 4a is on the outside of the boot (FIG. 3). On the inside, this rivet is riveted to a washer 8 covering a hollow 9 made in the inner wall of the shell 1. In FIG. 2 the washer 8 has been removed to show the passage of the cord. Starting from the stretcher 7, the cord 5, first guided by the inner edge of the rear cover 3 where it changes direction, penetrates inside the shell 1 via a hole 10 provided in the shell and opening into the hollow 9. The cord 5 then crosses the hollow 9, under the rivet 4, bearing against this rivet. It then ascends diagonally, passes over the pressure distributor 6 and then into a return device 11 comprising a folded piece of sheet metal riveted to the inner wall of the shell opposite the rivet 4. The cord 5 then passes back in the other direction over the pressure distributor 6, descends back diagonally substantially parallel to the proceeding strand 5a, penetrates into the hollow 9 under the washer 8, sliding on the rivet 4, then emerges from the shell via the hole 10, its other end being fixed at 12 to the cord itself, between the hole 10 and the stretcher 7.

During flexion of the leg, the shank of the boot, that is to say likewise the rear cover 3, pivots forward about its articulation. During this movement, the strand 5a of the cord 5 undergoes a traction due to the elongation of the path between the pressure distributor 6 and the stretcher 7. Simultaneously, however, the point of attachment 12 of the strand 5a moves closer to the pressure distributor 6, permitting the strand 5b of the cord to shorten, this shortening compensating the elongation of the strand 5a. The loop formed by the strands 5a and 5b slides in the return device 11, and the traction on the pressure distributor 6 is ultimately not modified.

In order to obtain a completely neutral behaviour of the clamping device during flexion of the leg, it is appropriate for the cable strands 5a and 5b to pass equidistant from the geometric axis of the articulation of the shank, that is to say the axis of the rivet 4.

Numerous alternative embodiments are possible. In particular, the two ends of the cable 5 could be attached to the stretcher 7, the two strands 5a and 5b being of course guided parallel, for example in a common guide path. In the region of the rivet 4, the strand 5b could pass under a material pivot fixed to the shell 1. The two cable strands 5a and 5b could pass at a certain distance from the rivet 4. The return device 11 could take the form of a sheave pulley instead of a simple keeper such as the keeper 11. In principle, a second cord analogous to the cord 5 could pass on the other side of the boot and over the pressure distributor 6, below the strand 5a.

The invention is likewise applicable to a rear-entry boot of which only the rear cover is articulated about a pivot.

I claim:

1. A ski boot formed of a lower part (1) in the form of a shell, comprising the sole and surrounding at least the foot and the heel, and a shank formed by a front part (2) and a rear part (3) whereof at least the rear part (3) is articulated on the lower part (1) about a transverse pivot (4), and comprising diagonal gripping means formed by a pressure distributor (6) situated within the boot, at the level of the instep, and a stretcher device (7) mounted at the back of the boot, on said articulated rear part (3) of the shank, in order to exert a traction on the pressure distributor towards the heel by means of at least one cord (5) passing over said distributor and guided by guide means disposed laterally on the boot in order to orient the action of the cord on the distributor towards the heel, wherein the cord (5) forms a loop passing, on one side of the boot both below and above the pivot of articulation (4) of the rear part of the shank, substantially at the same distance from this pivot, and, on the other side of the boot freely through a return device (11) fixed to the inside of the shell, in a manner such that during flexion of the shank of the boot the traction exerted by the cord on the distributor is virtually unchanged.

2. The ski boot as claimed in claim 1, wherein the two ends of said loop are connected to the stretcher device.

3. The ski boot as claimed in claim 1, wherein one of the ends of the cord is connected to the stretcher device, the other end of the cord being fixed to the cord at a point (12) situated between the stretcher device and the pivot of articulation of the shank.

4. The ski boot as claimed in claim 1, wherein, in the zone of articulation of the shank, the cord is guided on the one hand by the pivot (4) of the articulation and on the other hand by a hole passing through the shell or by a projection formed in the material of the shell.

* * * * *